US010118718B2

(12) United States Patent
Manaresi et al.

(10) Patent No.: US 10,118,718 B2
(45) Date of Patent: Nov. 6, 2018

(54) APPARATUS AND METHOD FOR PACKING A PRODUCT IN A CONTAINER COMPRISING AN EXTERNAL BODY AND AN INTERNAL BAG

(71) Applicant: GIMA S.p.A., Zola Predosa (Bologna) (IT)

(72) Inventors: Giorgio Manaresi, Rome (IT); Luca Benni, Bologna (IT)

(73) Assignee: GIMA S.P.A, Zola Predosa (IT)

( * ) Notice: Subject to any disclaimer, the term of this patent is extended or adjusted under 35 U.S.C. 154(b) by 137 days.

(21) Appl. No.: 15/023,620

(22) PCT Filed: Sep. 17, 2014

(86) PCT No.: PCT/IB2014/064591
§ 371 (c)(1),
(2) Date: Mar. 21, 2016

(87) PCT Pub. No.: WO2015/040553
PCT Pub. Date: Mar. 26, 2015

(65) Prior Publication Data

US 2016/0288936 A1 Oct. 6, 2016

(30) Foreign Application Priority Data

Sep. 20, 2013 (IT) ..... BO2013A0507

(51) Int. Cl.
*B65B 29/02* (2006.01)
*B65B 43/48* (2006.01)
(Continued)

(52) U.S. Cl.
CPC ..... *B65B 29/02* (2013.01); *B31D 5/0082* (2013.01); *B65B 29/022* (2017.08); *B65B 43/48* (2013.01);
(Continued)

(58) Field of Classification Search
CPC ..... B65B 29/02; B65B 29/022; B65B 29/028; B65B 43/48; B65B 43/50; B65B 47/00;
(Continued)

(56) References Cited

U.S. PATENT DOCUMENTS 3,385,025 A * 5/1968 Lemelson ..... B65B 3/02 53/453
9,630,732 B2 * 4/2017 Hodler ..... B65B 29/02
2008/0314256 A1 * 12/2008 Smith ..... B65D 85/816 99/298
2009/0211713 A1 * 8/2009 Binacchi ..... B65B 29/02 156/423
(Continued)

FOREIGN PATENT DOCUMENTS

WO WO 2011/047836 A1 4/2011
WO WO 2013/064988 A1 5/2013
WO WO2013/134885 A1 9/2013

*Primary Examiner* — Hemant M Desai
*Assistant Examiner* — Valentin Neacsu
(74) *Attorney, Agent, or Firm* — R. Neil Sudol; Henry D. Coleman

(57) ABSTRACT

An apparatus for packing a food product in a container to be used in infusion machines, preferably to obtain a beverage such as coffee, includes a frame for supporting means for feeding an external body of the container and means for making and inserting a bag configured with fluted sidewalls in the external body. The means for making and inserting the bag has at least one operating unit with a bag making component, an insertion component, and a conveyance for transporting the bag between the making component and the insertion component.

20 Claims, 7 Drawing Sheets

(51) Int. Cl.

| | |
|---|---|
| ***B65B 43/50*** | (2006.01) |
| ***B65B 47/06*** | (2006.01) |
| ***B65B 61/20*** | (2006.01) |
| ***B31D 5/00*** | (2017.01) |

(52) U.S. Cl.
CPC ..... *B65B 43/50* (2013.01); *B65B 47/06* (2013.01); *B65B 61/20* (2013.01)

(58) Field of Classification Search
CPC ..... B65B 47/04; B21D 22/02; B21D 22/025; B21D 85/8043; B21D 85/8046; B21D 85/816
USPC ..... 493/56, 59, 61–62, 73, 74, 79, 81, 82; 53/410, 435, 513, 520; 220/669–673
See application file for complete search history.

(56) References Cited

U.S. PATENT DOCUMENTS

2012/0055305 A1* 3/2012 Betti ..... B26D 1/626 83/436.3
2012/0190520 A1* 7/2012 Rivera ..... B31B 1/00 493/56
2012/0190521 A1* 7/2012 Rivera ..... B31D 5/0082 493/58
2012/0269933 A1* 10/2012 Rapparini ..... B65D 85/8043 426/82
2014/0230370 A1* 8/2014 Bianchi ..... B65B 29/02 53/410
2015/0020481 A1* 1/2015 Hodler ..... B65B 29/02 53/435
2016/0288936 A1* 10/2016 Manaresi ..... B65B 29/02

* cited by examiner

APPARATUS AND METHOD FOR PACKING A PRODUCT IN A CONTAINER COMPRISING AN EXTERNAL BODY AND AN INTERNAL BAG

TECHNICAL FIELD

This invention relates to an apparatus and a method for packing a product in a container. More specifically, this invention relates to an apparatus and a method for packing an infusion or extraction product in a container, advantageously a single-use capsule, comprising a bag configured with fluted sidewalls.

BACKGROUND ART

There are prior art apparatuses for packing coffee in a respective container to be used in infusion machines, wherein the container is of the type comprising an external body, and an internal bag in particular configured with fluted sidewalls, and containing coffee.

The prior art apparatuses comprise, basically, a frame for supporting means for feeding the container and means for making and inserting the bag inside the external body of the container; which are of the compact type and comprise a single station, or means, for cutting a portion of material for bags by means of a corresponding circular blade and a piston for pushing the portion of material for bags into a hopper for forming the bag with fluted sidewalls and then into an external body of the container, which is located below the forming hopper on the means for feeding the containers.

A drawback of these prior art machines is the inability to perfectly shape the fluted sidewalls of the bag, which results in subsequent problems for sealing the bag to the external body of the container and the making of packages with a quality poor or which must be rejected, with consequent economic losses and possible stoppages in the packing operations of the apparatus.

More specifically, in these prior art apparatuses, it is necessary to use corresponding and complex devices for arranging the bag inside the external body of the container, after it has been shaped and positioned using prior art making and inserting means.

Moreover, in these prior art machines a device is used for making and inserting the bag which is excessively complex, difficult to assembly and complicated in terms of maintenance and repairs.

DISCLOSURE OF THE INVENTION

This invention therefore proposes a new solution as an alternative to the solutions known up to now and more specifically, proposes to overcome one or more of the above mentioned drawbacks and/or problems and/or to meet one or more of the needs felt in the trade or inferable from the above.

An apparatus and a method is therefore provided for packing an infusion or extraction product in a container comprising a bag configured with fluted sidewalls according to claim 1 and claim 17, respectively.

With an apparatus and a method according to the invention it is possible to uncouple the step of making the bag from that of inserting the bag inside an external body of the container, thus achieving the possibility of performing repairs, maintenance and tests in an easier fashion and also providing devices which perform the operations in a less complicated and more reliable manner, with obvious advantages in terms of productivity and the quality of the product.

Furthermore, with an apparatus and a method according to the invention it is possible to form the bag configured with fluted sidewalls in a precise and safe manner.

Moreover, in multi-row apparatuses it is possible to obtain high cutting efficiencies, that is, minimising the waste material.

This invention further provides a device for making a bag configured with fluted sidewalls according 15.

BRIEF DESCRIPTION OF THE DRAWINGS

These and other innovative aspects are set out in the appended claims and the technical features and advantages are also apparent from the detailed description which follows of a preferred, advantageous embodiment of it which must be considered purely as a non-limiting example. The description is made with reference to the accompanying drawings, in which

DETAILED DESCRIPTION OF PREFERRED EMBODIMENTS OF THE INVENTION

Figure 1:
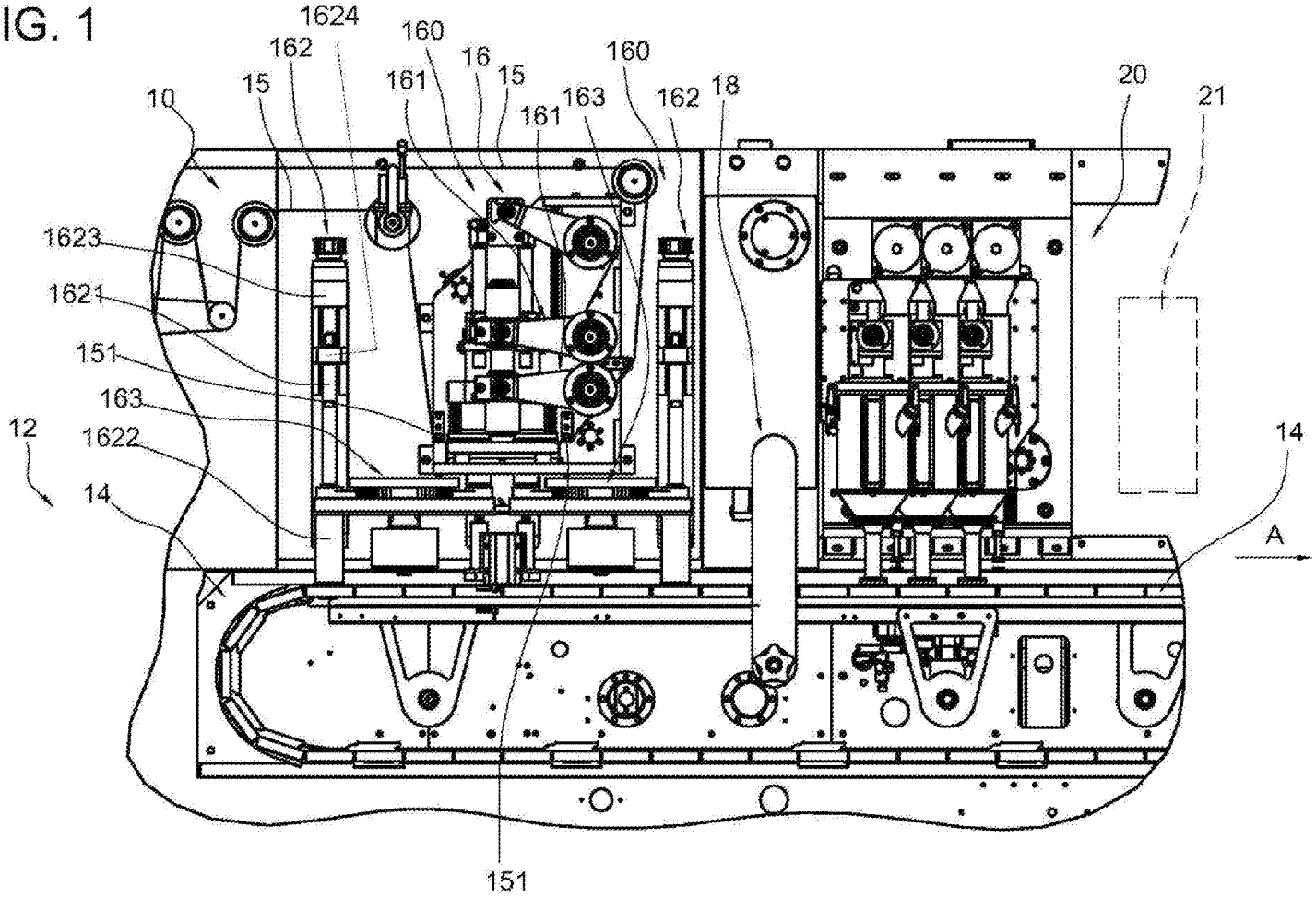
FIG. 1 is a front view of a preferred embodiment of the apparatus according to the invention.
Figure 2:
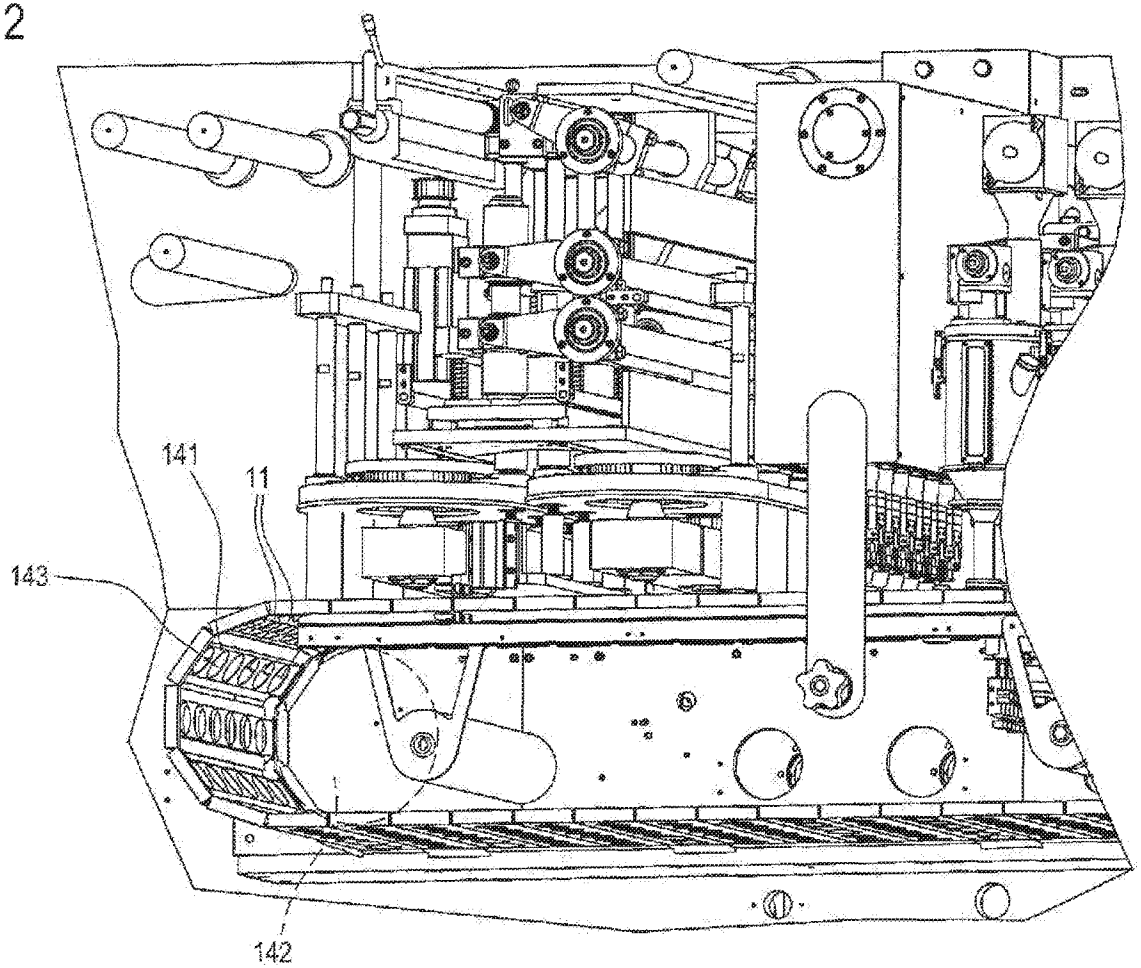
FIG. 2 is a schematic perspective view of a zone for forming and inserting hags of the preferred embodiment of the apparatus according to the invention.

The accompanying drawings, in a preferred embodiment of the invention, illustrate an apparatus 10 for packing a product in a container to be used in respective infusion machines to obtain a corresponding beverage, preferably in the form of coffee or a coffee-based beverage, in particular to obtain a filter coffee. Advantageously, the container is a single-use capsule for infusion or extraction beverages.

This container is of the type comprising an external supporting body 11, preferably in the general shape of truncated cone, which is designed to house and retain inside it a respective bag 13, in particular configured with fluted sidewalk, which is in turn designed to contain a dose of product, and which is preferably made of a suitable porous or filtering material, for example filter paper.

More specifically, the external body 11 for supporting the container is suitably shaped so that it can be located in corresponding shaped seats of the infusion machine, during the operation for infusion of the beverage.

In turn, the bag 13 comprises a base, preferably circular, from which a peripheral wall extends, flared in a direction transversal to the base and shaped with pleats and obtained using a plurality of longitudinal fold lines.

The apparatus 10 comprises means 14 for feeding the external body 11 or the container being set up, movable along a feed direction A, along a respective operating path between different operating stations of the apparatus. The feed means 14 are preferably in the form of an endless conveyor belt 141, with articulated sectors, which is rotatable on respective end wheels, of which only one denoted by the numeral 142 is illustrated in the accompanying drawings.

As illustrated, the endless conveyor belt 141 defines a plurality of cavities or recesses 143 for housing and supporting a respective external body 11 of the container.

More specifically, there are a plurality of parallel rows of recesses 143 along the feed direction A (in the embodiment illustrated there are six parallel rows) for simultaneous and parallel feeding of a plurality of external bodies 11 or containers being set up.

The apparatus 10 also comprises, in sequence along the feed direction A, a station 16 for making and inserting the bag 3 inside the external body of the container, a joining station 18 to join, in particular to seal, the bag to the external body 11 of the container, a filling station 20 to fill the bag with a dose of product and a closing station 21 (schematically illustrated in FIG. 1) for closing the external body with, a closing sheet.

The apparatus 10 also comprises a fixed frame 12 supports the feeding means 14, the station 16 for making and inserting the bag 13, the joining station 18, the filling station 20 and the closing station 21.

Advantageously, the station 16 for making and inserting the bag 13 comprises at least one operating unit 160 for making and inserting the bag 13 which comprises, respectively, a device 161 for making the bag 3, a device 162 for inserting the bag 13 inside the external body 11 of the container, and a device 163 for conveying the bag 13 from the making device 161 to the inserting device 162.

Advantageously, the apparatus 10 comprises a first and a second operating unit 160, 160 for making and inserting the bag 13 comprising, respectively, a first and a second device 161 for making the bag 13, a first and a second device 162 for inserting the bag 13 inside the external body 11 of the container, and a first and a second device 163 for conveying the bag 13 from the first and second making device 161 to the first and second inserting device 162, respectively.

In this way, it is possible to uncouple the operation of making the bags from the operation of inserting the bag inside the external body of the container, which is advantageous in terms of the quality of performing the operations and simplifies the construction and maintenance of the devices used.

More specifically, it is possible to obtain a bag, formed with fluted sidewalls, which presents a better shape, as will become clearer as this description continues, and also to obtain a better insertion of the bag inside the external body of the container, thereby being able to omit corresponding devices for arranging and adjusting the bag inside the external body of the container, as was the case with the machines according to the prior art.

In practice, the respective devices 161, 161 for making the bag, and the respective devices 162, 162 for inserting, the bag 13 inside the external body 11 of the container are spaced from each other along the feed direction A and, more specifically, are longitudinally spaced from each other.

More specifically, in the first operating unit 160, located upstream of the second operating unit 160 along the feed direction A, the first device 162 for inserting the bag 13 inside the external body 11 of the container is provided upstream relative to the first device 161 for making the bag along the feed direction A.

Conversely, in the second operating unit 160, located downstream of the first operating unit 160 along the feed direction A, the second device 162 for inserting the bag 13 is provided downstream relative to the second device 161 for making the bag along the feed direction A.

Advantageously, the first and second units 160, 160 for making and inserting the bag 13 inside the external body 11 of the container operate on a single strip 15 of filter material.

More specifically, the first and second units 160, 160 for making and inserting the bag 13 are adjacent to each other along the feed direction A and transversally offset, more specifically transversely offset by a row of recesses 143.

Figure 3:
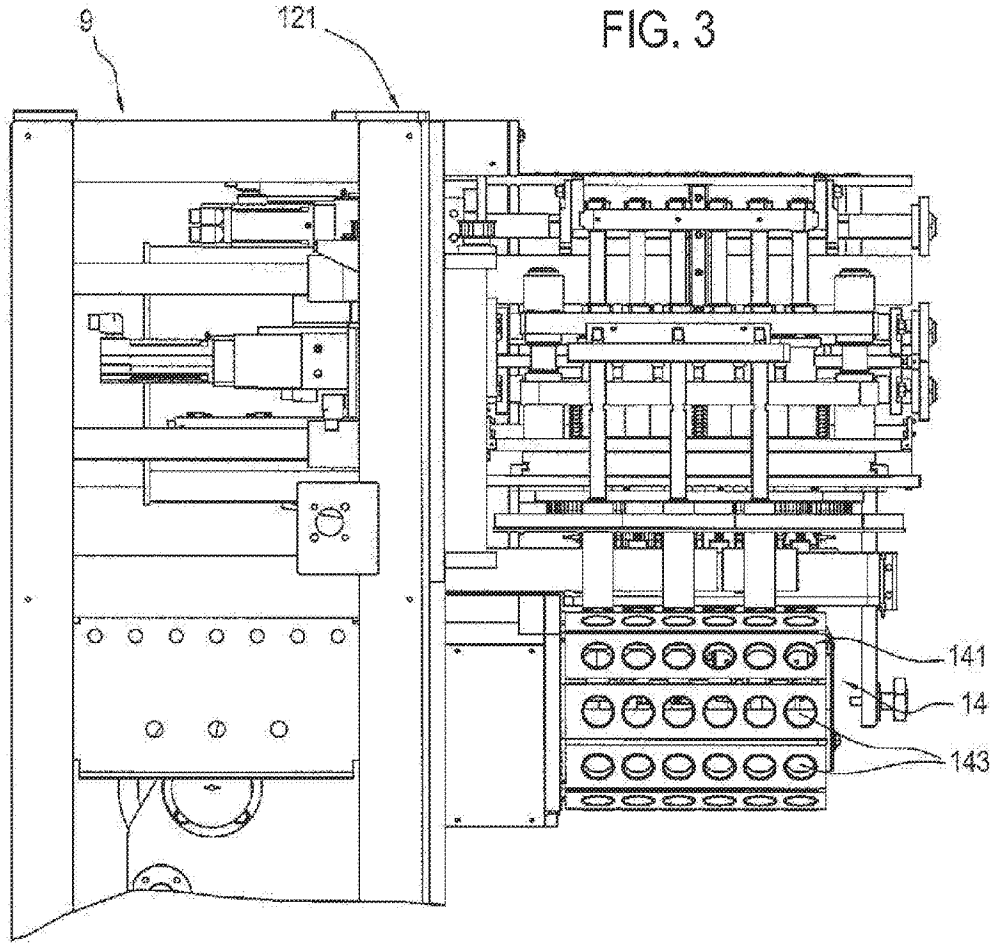
FIG. 3 is a lateral view of the side of the upstream head of the preferred embodiment of the apparatus according to the invention.

As may be inferred in particular from FIG. 3, the supporting frame 12 comprises an intermediate wall 121, in particular which extends longitudinally and which separates drives 9 of the apparatus 10 from the operating stations of the apparatus.

With reference to FIG. 1, the numeral 151 denotes rollers for driving the belt 15 of filter material to, and from, the operating unit 160.

More specifically, the first unit 160 for making and inserting the bags 13 operates on first external bodies 11 of the containers, whilst the second unit 160 for making and inserting the bags 13 operates on second external bodies 11 of the containers, the first external bodies 11 of the containers being offset relative to the second external bodies 11 of the containers in the feed direction A, in particular transversely to the feed direction A.

Correspondingly, as will become dearer as this description continues, respective parts or components of the first and second operating unit 160, 160 for making and inserting the bags 13 are offset from each other transversely to the feed direction A.

More specifically, as illustrated, the first operating unit 160 operates on first three external bodies 11 whilst the second lint 160 operates on second three external bodies 11 which, however, are positioned on interposed, or offset, rows relative to the rows of the first three external bodies 11 on which the first unit 160 operates.

In practice, the respective making and inserting unit 160, 160 feeds the corresponding bags to the respective first external bodies 11 which are located, in the feed direction A, upstream and to the second external bodies 11 which are located, in the same feed direction A, downstream.

Figure 4:
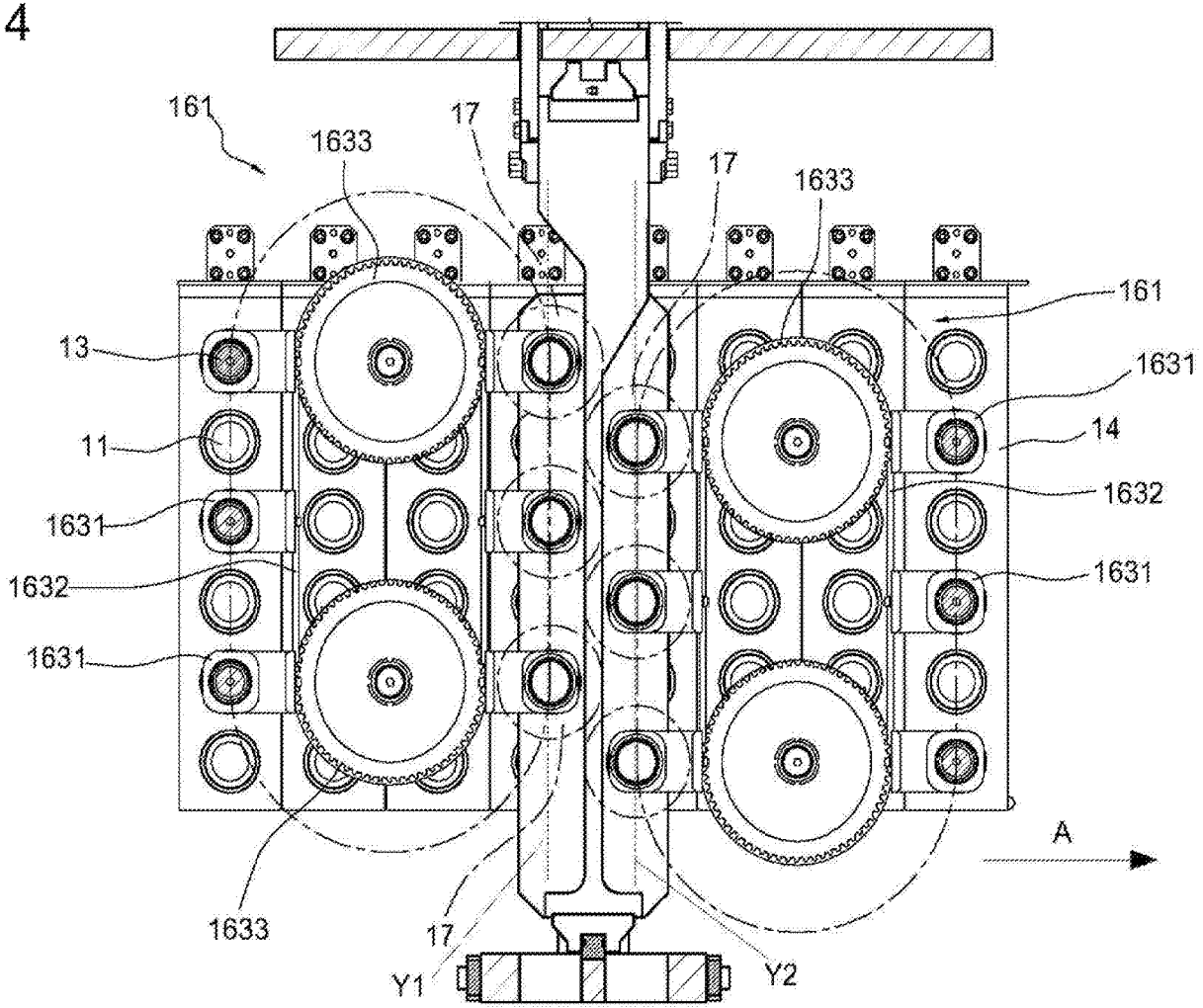
FIG. 4 is a schematic top plan view of the zone for making and inserting bags.
Figure 5:
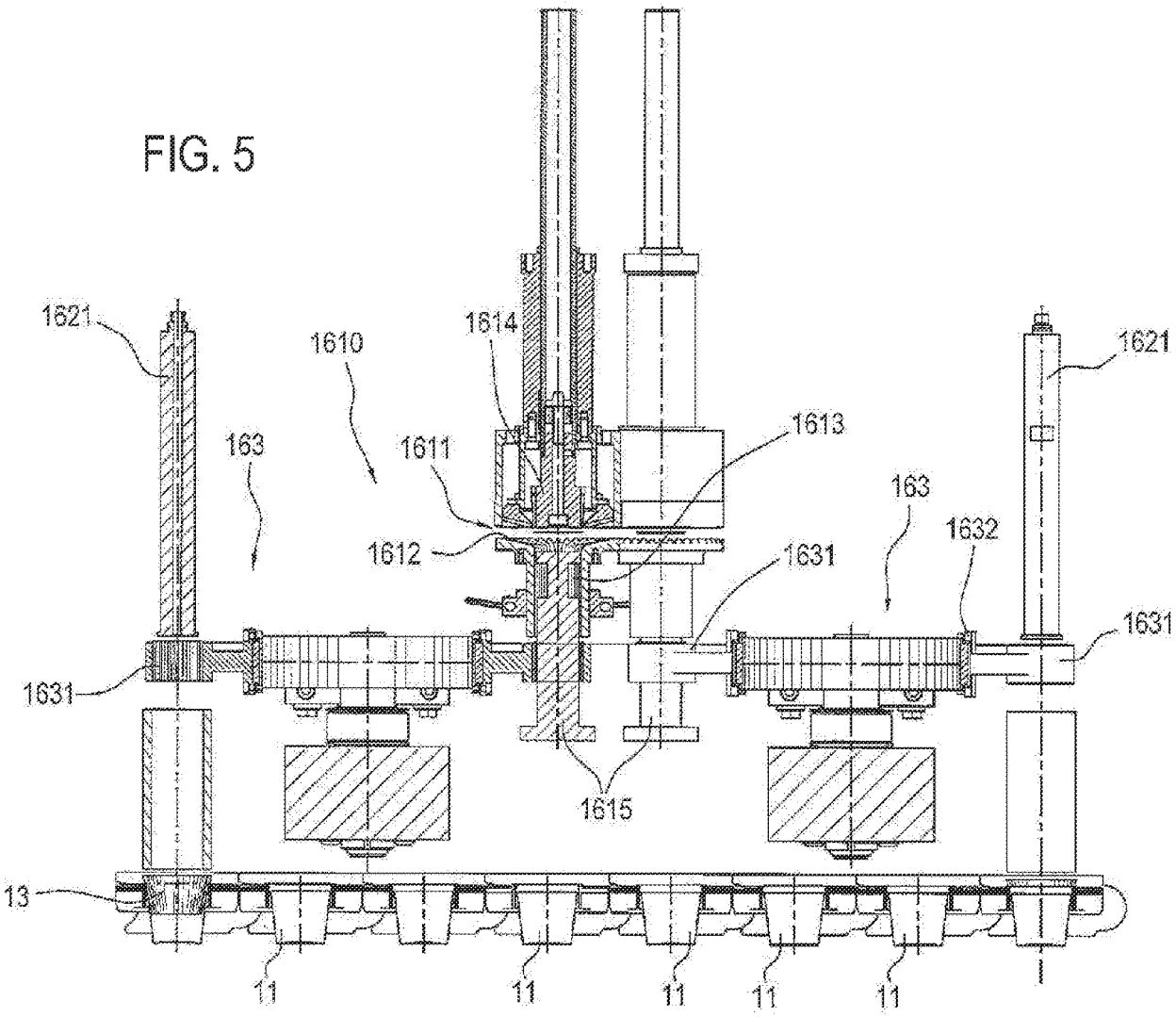
FIG. 5 is a schematic front view, partly in cross section, relative to an operating condition of the making means, with soars components omitted for reasons of clarity.

As may be well inferred from FIG. 4, the first and second devices 161, 161 for making the bags 13 of the first and second units 160, 160 are provided mutually adjacent so as to separate, in particular to cut, from a single strip 15 of filter material corresponding portions 17 in particular disc or circular-shaped, for making corresponding bags 13.

Advantageously, the devices 161, 161 for making the bags 13 cut, in the strip 15 of filter material, respective portions 17 for the bag 13, which are offset from each other, in particular along a direction transversal to the feed direction A. In this way, it is possible to obtain a better use of the strip 15 with advantageous saving of material.

More specifically, advantageously, the devices 161, 161 for making the bag of the first and second units 160, 160 comprise respective means 1610 for cutting respective portions 17 for the bag 13, the cutting means 1610 being positioned in such a way as to make, respectively, first portions 17 and second portions 17. The first portion 17 and the second portions 17 are spaced along the feed direction A and offset from each other along a direction transversal to the feed direction A.

The cutting means 1610 of the first making devices 161 of the first operating unit 180 are positioned substantially aligned along a first axis Y1, advantageously perpendicular to the feed direction A of the external bodies 11, whilst the cutting means 1610 of the second making devices 161 of the second operating unit 160 are positioned substantially aligned along a second direction Y2, parallel to the first direction Y1, advantageously perpendicular to the feed direction A.

Consequently, the first portions 17 made by the cutting means 1610 of the first making devices 161 of the first operating unit 160 have centres which lie on the first direction Y1, and the second portions 17 for the bag made by cutting means 1610 of the second making devices 161 of the second operating unit 160 have centres which lie on the second direction Y2, respectively.

Advantageously, the first direction Y1 and the second direction Y2 are spaced by less than the diameter of a portion 17 for the bag.

Generally speaking, in alternative embodiments not illustrated, the cutting means 1610 may be designed to make portions 17 having a shape different from the circular shape. In these alternative embodiments, the cutting means 1610 of the first making device 161 make first non-circular portions 17 aligned along the first direction Y1, whilst the cutting means 1610 of the second making device 161 make second non-circular portions 17 aligned along the second direction Y2, the first direction Y1 and the second direction Y2 being spaced less than a maximum dimension along the feed direction A of the non-circular portions 17.

In general, providing the cutting means 1610 of the first operating unit 160 and the cutting means 1610 of the second operating unit 160 offset transversely to the feed direction A makes it possible to minimize the waste. In other words, it is possible to make portions 17 on the strip 15 spaced at less than the distance between two successive external bodies 11 positioned on the same row of the feed means 14.

In this way, it is possible to use a strip 15 with reduced transversal dimensions and, at the same time use the strip 15 in an optimum manner also in the feed direction A.

More in detail, the cutting means 1610 comprise a blade, or punch, 1611, advantageously circular, which acts in conjunction with a counter-blade, or die, 1612.

The die 1612 is advantageously located at an upper end of the forming means, advantageously a forming hopper 1613, in which the portion 17 for the bag 13 is pushed by pushing means to be shaped with fluted sidewalls. Advantageously, the pushing means comprise a corresponding piston 1614. The piston 1614 is movable coaxially to the respective punch 1611.

The device 161 for making the bag 13 comprises at least one piston 1614 designed to engage a face, in particular an upper face, of the portion 17 for the bag and to push the portion 17 for the bag in the corresponding forming means, advantageously in the forming hopper 1613.

Advantageously, the device 161 for making the bag 13 comprises accompanying means, which act in conjunction with the pushing means, to accompany the portion 17 for the bag through the corresponding forming means 1613.

More specifically, the accompanying means comprise an additional piston 1615 designed to engage with a face, in particular a lower face, of the portion 17 for the bag. The additional piston 1615 is designed to accompany the portion 17 for the bag through the forming hopper 1613.

In practice, retaining the portion 17 for the bag between opposite means during insertion into the forming means 1613 prevents the portion 17 from remaining retained, or fixed, on one side thereby resulting in bags which are deformed or not fully formed, as is the case with the machines according to the prior art.

More specifically, the additional piston 1615 is movable between a raised position, in which it extends inside the forming hopper 1613, and a lowered position, to transfer the bag 17, with fluted sidewalls to the conveying device 163.

The additional piston 1615 is moved in phase coordination with the piston 1614 for conveying the portion 17 gradually inside the forming means 1613.

In other words, the additional piston 1615 is moved in phase coordination with the piston 1614 for clamping for forcing the portion 17 inside the forming means, or forming hopper 1613.

During the forming step, the portion 17 is retained by and between, the pushing means and the accompanying means, advantageously between the piston 1614 and the additional piston 1615.

The forming hopper 1613 comprises suitable projections for folding the portion 17 with fluted side ally.

As may be inferred, the additional piston 1615, whilst accompanying the portion 17, moving vertically, passes through a corresponding seat 1631 of the conveying means 163 located below the forming hopper 1613.

Figure 6:
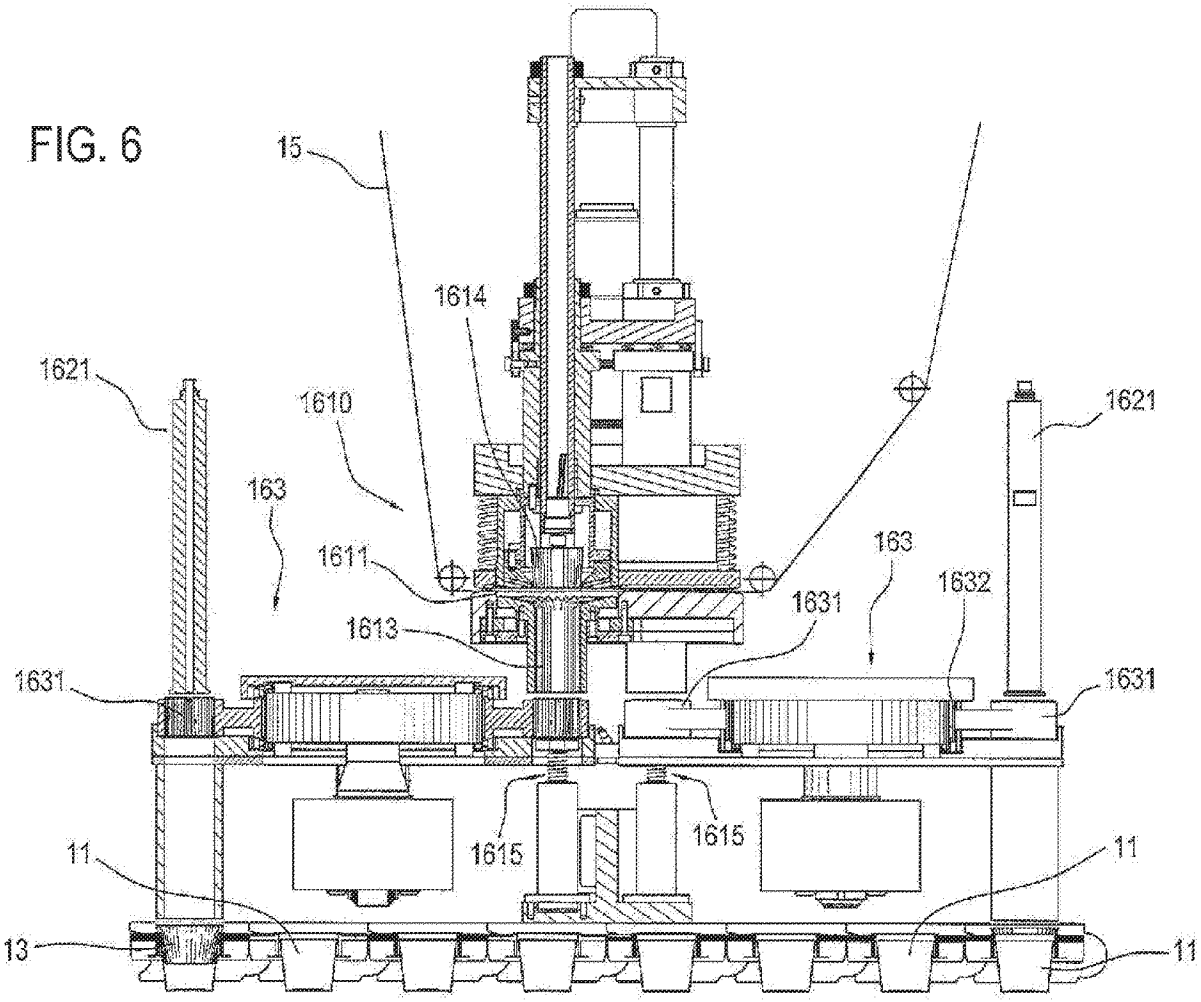
FIG. 6 is a partial cross section similar to that of FIG. 5 and relative to a different operating condition of the making means, with some components omitted for reasons of clarity.
Figure 7:
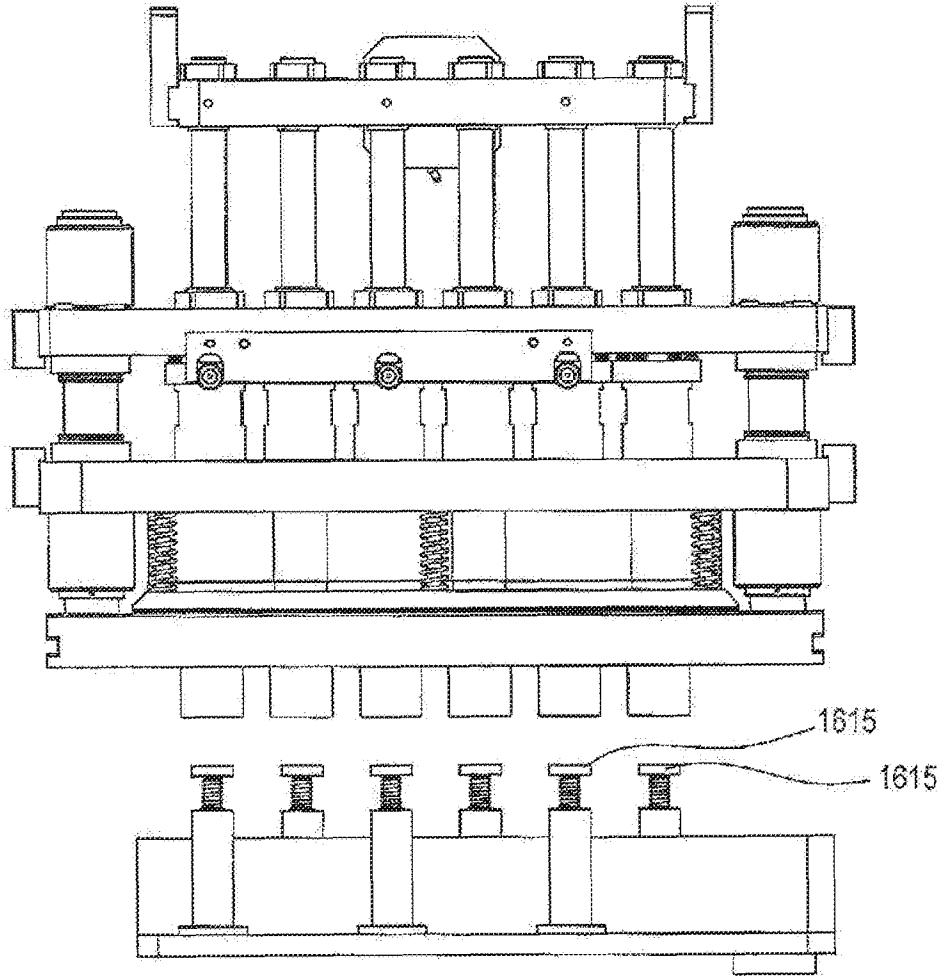
FIG. 7 is a schematic lateral view showing a zone of accompaniment of the bags being formed in the preferred embodiment of an apparatus according to the invention.

In the lowered position, illustrated in FIG. 6, the additional piston 1615 is under the corresponding seat 1631 of the conveying means 163, not interfering with the conveying means 163 which transfer the bags 13 towards the inserting means 162.

Advantageously, as illustrated, the conveying device 163 moves in a horizontal plane. Advantageously, the horizontal plane is parallel to a plane on which the external bodies 11 of the containers lie, that is, above the means 14 for feeding the external bodies 11 and beneath the forming hopper 1613.

The conveying device 163 comprises an endless supporting belt 1632, carried by corresponding drive and transmission pulleys 1633, the endless supporting belt 1632 supporting a plurality of seats 1631, which are designed to be positioned, alternately, at the making means 161 and the inserting means 162. The endless supporting belt 1632 moves the plurality of seats 1631 on a horizontal plane parallel with the feed direction A, that is, above the feed means 14 of the external bodies 11 and below the forming hopper 1613.

More in detail, the respective seat 1631 of the conveying means 163 comprises a corresponding through hole for housing the bag 13, suitably, sized for retaining the respective bag 13 by interference.

As mentioned, the apparatus illustrated in the drawings comprises a first conveying device 163 and a second conveying device 163, which comprise, respectively, a first and a second endless supporting belt 1632, rotating in opposite directions, on a horizontal plane, above the feed means 14. Alternatively, the endless supporting, belts rotate in the same direction, with an adjustment in the distance between directions or lines Y1 and Y2 to provide necessary clearance. Each endless supporting belt 1632 supports at least one seat 1631. Advantageously, each belt supports a plurality of seats 1631.

More specifically, the first endless supporting belt 1632 supports a first series of seats 1631 and the second endless supporting belt 1632 supports a second series of seats 1631.

Advantageously the first series of seats 1631 conveys the bags 13 from the first making device 161 of the first operating unit 160 upstream of the feed direction A at the first inserting device 162, whilst the second series of seats 1631 conveys the bags 13 from the second making device 161 of the second operating unit 160 downstream of the feed direction A at the second device 162 for inserting the bag.

Advantageously, the first and the second device 162, 162 for inserting bag 13 inside the external body 11 of the container comprise relative first and second means for engaging and pushing the bag formed with fluted sidewalls inside the respective external body 11 of the container.

Advantageously, the means for engaging and pushing the bag formed with fluted sidewall inside the respective body 11 of the container comprise respective pushers, for example respective pistons passing through the respective seat 1631 supporting the conveying devices 163. The engaging and pushing means are also designed to pass through a corresponding tubular body 1622 provided between the respective supporting seat 1631 of the conveying devices 163 and the housing and supporting seat 143 of the feed means 14.

As illustrated, the means for engaging and pushing the bags formed at fluted sidewalls inside the respective external body of the container are carried by a corresponding and shared frame 1623, which is driven by a corresponding crank mechanism 1624.

In the embodiment illustrated, the first and second engaging and pushing means each comprise three pushers 1621.

In turn, the pushers 1621 are driven along vertical directions, to push the bags 13 from the top downwards inside a respective external body 11.

Advantageously, the pushers 1621 of the first and second engaging and pushing means are positioned on rows transversal to the feed direction A of the containers. More specifically, the pushers 1621 of the first engaging and pushing means are positioned along a first row upstream of the respective first device 161 for making the bag 13, whilst the pushers 1621 of the second engaging and pushing means are positioned along a second row downstream of the respective second device 161 for making the bag 13.

More specifically, the pushers 1621 of the first row are positioned in alternating rows of seats 143, and the pushers 1621 of the second row are positioned in alternating rows of seats 143 which are different from those of the first row of pushers 1621.

In other words, a first half of external bodies present on an articulated sector of the endless conveyor belt 141 are fed with a respective bag 13 from the first row of pushers 1621, whilst a second half of containers present on the articulated sector of the endless conveyor belt 141 are fed with a respective bag 13 from the second row of pushers 1621.

According to the invention, a method is also provided for packing an infusion or extraction product in a container, advantageously a single-use capsule for infusion or extraction beverages, comprising an external body 11 and a bag 13 made of suitable porous and/or filter material and configured with fluted sidewalls.

The method according to the invention comprises the steps of feeding plurality of external bodies 11 of containers according, to a plurality of rows parallel inside respective seats 143 of means 14 for feeding along a feed direction A. feeding a strip 15 of filter material; —obtaining, by cutting, from the strip of filter material a plurality of portions 17 designed to make a bag with fluted sidewalls; —folding the portions 17 to form corresponding bags with fluted sidewalls at a device 161 for making the bag 13; —inserting the bags 13 in corresponding seats 1631 of a conveying device 163; —moving the seats 1631, upstream or downstream of the device 161 for making the bag 13 with respect to the feed direction A, for positioning the bags 13 above corresponding external bodies 11; and inserting the bags 13 inside corresponding external bodies 11 housed inside the respective seats 143 of the feed means 14.

Advantageously, the step of folding the portions 17 to form corresponding bags 13 configured with fluted sidewalls comprises clamping the portions 17 between pushing means, for example a piston 1614 designed to engage an upper face of the portion 17 and engaging means, for example an additional piston 1615, designed to engage a lower face of the portion 17 and force the portion 17 clamped in this way inside forming means, for example a forming hopper 1613.

Advantageously, the step of obtaining, by cutting from, the strip 15 of fitter material a plurality of portions 17 designed to make a bag 13 with fluted sidewalls comprises obtaining, by cutting, first portions 17 aligned along a first direction Y1 and second portions 17 aligned along a second direction Y2, parallel to the first direction Y1.

Advantageously, the first Y1 and the second Y2 direction are m parallel and transversal to the feed direction A.

As indicated above, it is possible to obtain, by cutting, first portions 17 and second portions 17 from a same strip 15 of filter material. Advantageously, the first portions 17 are offset relative to the second portions 17 along a direction at right angles to the feed direction A.

Advantageously, the method comprises inserting the bags 13 obtained from the first portions 17 inside first external bodies 11 and the bags 13 obtained from the second portions 17 inside second external bodies 11, the first external bodies 11 being offset along the feed direction A relative to the second external bodies 11.

Advantageously, the first external bodies 11 are positioned upstream the second external bodies 11.

The invention described above is susceptible of industrial application. It would be obvious to one skilled in the art that several changes and modifications can be made to the invention without departing from the spirit and scope of the invention, described in depth above. It is also easy to imagine further embodiments of the invention comprising one or more of the features described herein. Moreover, it will be understood that all the details of the invention may be substituted for technically equivalent elements.

The invention claimed is:

1. An apparatus for packing an infusion or extraction product in a container, the container comprising an external body and a bag made of porous and/or filter material and configured with fluted sidewalls, the apparatus comprising:

a supporting frame, a feeding member configured to support and move a plurality of external container bodies in a feed direction, and a first and a second making and inserting unit, each comprising:

a respective making device configured to cut circular-shaped portions from a single strip of material and to make a plurality of bags from respective ones of the circular-shaped portions;

a respective inserting device for inserting the bags inside respective ones of the external bodies; and a respective conveying device for conveying the bags from the respective making device to the respective inserting device, the making devices of the first and the second making and inserting unit being located upstream and downstream, respectively, of the corresponding respective inserting device along the feed direction;

wherein the first and second making and inserting units operate on respective first and second external bodies, with the first external bodies being offset, as supported by the feeding member, relative to the second external bodies in a direction transverse or perpendicular to the feed direction, and wherein the making device of each of the first and the second making and inserting units comprises a pushing element for pushing first faces of the cut portions into a respective forming hopper and further comprises an accompanying element for accompanying the cut portions through the forming hopper, the accompanying element engaging second faces of the cut portions, opposite the first faces engaged by the pushing element.

2. The apparatus according to claim 1, wherein the pushing element and the accompanying element clamp one of the cut portions inside the forming hopper during the formation of a respective one of the bags.

3. The apparatus according to claim 1, wherein the conveying device of each of the making and inserting units comprises one or more seats for respective ones of the bags, the conveying device of each of the making and inserting units being designed to position the seats at the respective making device and the respective inserting device.

4. The apparatus according to claim 3, wherein the respective seat of the conveying device comprises a through hole.

5. The apparatus according to claim 4, wherein the accompanying element comprises a piston which, during formation of any one of the bags, configured with fluted sidewalls, passes through the through hole of the seat of the conveying device located below the forming hopper.

6. The apparatus according to claim 1, wherein the devices for inserting the bag inside the external bodies of the containers comprise respective pushers for pushing the bags inside the respective external bodies of the containers.

7. The apparatus according to claim 6, wherein the pushers comprise respective pistons passing through respective seats of the respective conveying devices and through a respective guide conduit provided between a respective seat and a respective housing and supporting cavity of the feeding member.

8. The apparatus according to claim 1, wherein the first and the second making and inserting units feed the bags to the respective first external bodies which are located, in the feed direction, upstream of the first making and inserting unit and to the second external bodies which are located, in the same feed direction, downstream of the second making and inserting unit.

9. The apparatus according to claim 1, wherein the first and the second making and inserting units operate on a single strip of material for bags.

10. The apparatus according to claim 9, wherein the devices for making the bags of the first and second making and inserting units are provided mutually adjacent so as to cut from the single strip of material circular-shaped portions for making corresponding or respective bags.

11. The apparatus according to claim 10, wherein the devices for making the bags of the first and second making and inserting unit comprise respective cutting means for cutting respective portions to make corresponding bags, the cutting means of the making devices of the first making and inserting unit being positioned substantially aligned along a first direction or line and the cutting means of the making devices of the second making and inserting unit being positioned substantially aligned along a second direction or line, parallel to the first direction or line, each of the first and the second direction or line being transverse to the feed direction.

12. A method for packing an infusion or extraction product in a container comprising an external body and a bag made of suitable porous and/or filter material and configured with fluted sidewalls, comprising the steps of:

feeding by a feeding member a plurality of external bodies of containers in a plurality of parallel rows inside respective housing and supporting cavities of the feeding member along a feed direction;

feeding a strip of porous and/or filter material;

obtaining, by cutting, from the strip of porous and/or filter material a plurality of portions each designed to make a bag with fluted sidewalls;

folding the portions to form corresponding bags with fluted sidewalls at a device for making the bag;

inserting the bags in corresponding seats of a conveying device;

moving the seats to position the seats and the bags above respective ones of the external bodies at locations upstream or downstream of the device for making bags with respect to the feed direction;

inserting the bags inside corresponding external bodies housed inside the respective housing and supporting cavities of the feeding member;

wherein the step of folding the portions to form corresponding bags with fluted sidewalls comprises clamping the portions between pushing elements, which engage upper faces of the portions, and accompanying elements, which engage lower faces of the portions, to form clamped portions and forcing the clamped portions inside a forming hopper, and in which first bags are inserted inside corresponding first external bodies and second bags are inserted inside second external bodies, the first external bodies being offset along the feed direction relative to the second external bodies.

13. The method according to claim 12, wherein the step of obtaining, by cutting, from the strip of porous and/or filter material a plurality of portions designed to make bags with fluted sidewalls comprises obtaining, by cutting, first portions disposed in a first direction or line and second portions disposed in a second direction or line, parallel to the first direction or line.

14. The method according to claim 13, wherein the first and the second direction or line are mutually parallel and oriented transversely to the feed direction.

15. The method according to claim 13, wherein the step of obtaining, by cutting, from the strip of porous and/or filter material a plurality of portions designed to make bags with fluted sidewalls comprises obtaining, by cutting, first portions disposed in the first direction or line and second portions disposed in the second direction or line, the first portions being offset with respect to the second portions.

16. The method according to claim 15, wherein the first and second portions have a maximum dimension along the feed direction, and wherein the first direction or line is spaced from the second direction or line by less than the maximum dimension along the feed direction.

17. The method according to claim 16, wherein the step of obtaining, by cutting, from the strip of porous and/or filter material first portions and second portions comprises obtaining first circular portions and second circular portions, which have centers aligned, respectively, along the first direction or line and the second direction or line, the first and the second direction or line being spaced by less than the maximum dimension from the first and second portions.

18. The method according to claim 13, wherein the step of moving the seats upstream or downstream of the making devices with respect to the feed direction comprises moving the bags obtained from the first portions upstream of the making device and moving the bags obtained from the second portions downstream of the making device with respect to the feed direction.

19. The method according to claim 12, wherein the step of inserting the bags inside corresponding external bodies housed inside the respective housing and supporting cavities of the feeding member comprises inserting the bags obtained from the first portions inside the first external bodies and the bags obtained from the second portions inside the second external bodies, the first external bodies being offset in a direction transverse or perpendicular to the feed direction with respect to the second external bodies.

20. An apparatus for assembling external bodies and filter bags into multiple containers and packing the assembled containers with an infusion or extraction product, the containers each comprising an external body and a filter bag, the apparatus comprising:

a feeding member for feeding the external bodies in a feed direction;

a first and a second making device each configured to cut circular-shaped portions from a single strip of filter material to make a respective subset of the filter bags;

a first and a second inserting device each configured to insert the filter bags of a respective said subset inside respective ones of the external bodies, wherein the first making device is downstream of the first inserting device along the feed direction and the second making device is upstream of the second inserting device along the feed direction, wherein the first inserting device is configured to insert the filter bags of the respective subset inside respective ones of the external bodies only upstream of the second inserting device along the feed direction and the second inserting device is configured to insert the filter bags of the respective subset inside the respective ones of the external bodies only downstream of the first inserting device along the feed direction, and wherein the first inserting device and the second inserting device are offset from each other in a direction transverse or perpendicular to the feed direction, so that the first inserting device and the second inserting device insert respective filter bags in different external bodies of a common row of external bodies disposed perpendicular to the feed direction.

* * * * *